US010907361B2

(12) United States Patent
Sawada

(10) Patent No.: US 10,907,361 B2
(45) Date of Patent: Feb. 2, 2021

(54) FIXTURE AND WALL STRUCTURE FOR BUILDINGS

(71) Applicant: NICHIHA CORPORATION, Nagoya (JP)

(72) Inventor: Youhei Sawada, Nagoya (JP)

(73) Assignee: NICHIHA CORPORATION, Nagoya (JP)

( * ) Notice: Subject to any disclaimer, the term of this patent is extended or adjusted under 35 U.S.C. 154(b) by 0 days.

(21) Appl. No.: 16/492,485

(22) PCT Filed: Jun. 25, 2018

(86) PCT No.: PCT/JP2018/024049
§ 371 (c)(1),
(2) Date: Sep. 9, 2019

(87) PCT Pub. No.: WO2019/004143
PCT Pub. Date: Jan. 3, 2019

(65) Prior Publication Data

US 2020/0087921 A1 Mar. 19, 2020

(30) Foreign Application Priority Data

Jun. 30, 2017 (JP) ..... 2017-128379

(51) Int. Cl.
*E04F 13/08* (2006.01)

(52) U.S. Cl.
CPC ..... *E04F 13/0803* (2013.01)

(58) Field of Classification Search
CPC ..... E04F 13/08
(Continued)

(56) References Cited

U.S. PATENT DOCUMENTS 2,043,706 A * 6/1936 Myers ..... E04F 13/0803 52/387
2,054,512 A * 9/1936 Kerner, V ..... E04F 13/0803 52/774

(Continued)

FOREIGN PATENT DOCUMENTS

JP 7-26688 A 1/1995
JP H10-110515 A 4/1998

(Continued)

OTHER PUBLICATIONS

International Search Report for PCT/JP2018/024049 (PCT/ISA/210) dated Aug. 21, 2018, with English translation.
U.S. Appl. No. 16/824,973, filed Mar. 20, 2020.

*Primary Examiner* — Jeanette E Chapman
(74) *Attorney, Agent, or Firm* — Birch, Stewart, Kolasch & Birch, LLP.

(57) ABSTRACT

[Object] To provide a fixture that can increase the degree of layout freedom of a contact fitting and facilitate construction and that can suppress a reduction in the strength and the durability of a building structure; and a wall structure for buildings.

[Solution] A fixture 10 can be provided with a contact fitting 30. The fixture 10 includes a substrate portion 11, a first side wall portion 12, a second side wall portion 13, a support portion 14, a first locking portion 15, a second locking portion 16, and a fixing plate portion 17. The fixing plate portion 17 extends from a distal edge 13A of the second side wall portion 13 so as to face the substrate portion 11, and is disposed at a location closer than the support portion 14 to the substrate portion 11. The contact fitting 30 includes a mounting portion 31 that is fixable to the fixing plate portion 17, and an erect piece 32 that is erect in a direction that intersects the mounting portion 31.

9 Claims, 5 Drawing Sheets

(58) Field of Classification Search
USPC ..... 52/506.1, 384, 404.1, 415
See application file for complete search history.

(56) References Cited

U.S. PATENT DOCUMENTS

| | | | | | |
|---|---|---|---|---|---|
| 2,099,337 | A * | 11/1937 | Hohl | E04F 13/0803 | 52/481.1 |
| 2,900,677 | A * | 8/1959 | Yetter | E04F 15/04 | 52/506.1 |
| 3,300,026 | A * | 1/1967 | Lens | B07C 3/082 | 198/704 |
| 3,533,206 | A * | 10/1970 | Passeno, Jr. | E04F 13/08 | 52/387 |
| 3,553,919 | A * | 1/1971 | Omholt | E04F 15/04 | 52/506.1 |
| 5,390,457 | A * | 2/1995 | Sjolander | E04F 13/0803 | 52/387 |
| 6,289,644 | B1 * | 9/2001 | Gerhaher | E04F 13/0826 | 52/235 |
| 8,621,810 | B2 * | 1/2014 | Manser | E04F 13/0871 | 52/506.05 |
| 8,621,910 | B2 * | 1/2014 | Biskeborn | G11B 5/40 | 73/7 |
| D766,465 | S | 9/2016 | Honda | | |
| D775,516 | S | 1/2017 | Honda | | |
| 2002/0032999 | A1 * | 3/2002 | Ito | E04F 13/0803 | 52/474 |
| 2013/0000238 | A1 | 1/2013 | Minami | | |

FOREIGN PATENT DOCUMENTS

| | | | |
|---|---|---|---|
| JP | H07-018817 | A | 1/1999 |
| JP | H11-336288 | A | 12/1999 |
| JP | 2001-090308 | A | 4/2001 |
| JP | 2002-138647 | A | 5/2002 |
| JP | 2003-074167 | A | 3/2003 |
| JP | 2004-270341 | a | 9/2004 |
| JP | 2004-332450 | a | 11/2004 |
| JP | 1415995 | S | 6/2011 |
| JP | 2013-011056 | a | 1/2013 |
| JP | 1504774 | S | 8/2014 |
| JP | 1505126 | S | 8/2014 |
| JP | D1506336 | A | 9/2014 |
| JP | 2015-074947 | a | 4/2015 |
| JP | 2015-194036 | a | 11/2015 |
| JP | 2016-102361 | a | 6/2016 |
| JP | 2017-002461 | a | 1/2017 |

* cited by examiner

FIXTURE AND WALL STRUCTURE FOR BUILDINGS

TECHNICAL FIELD

The present invention relates to a fixture and a wall structure for buildings.

BACKGROUND ART

Examples of fixtures of the related art are disclosed in PTL 1 to PTL 3. The fixture (fastener) disclosed in PTL 1 is used together with a joint filler that is disposed between left and right exterior wall plates (exterior materials) that are adjacent to each other. As shown in, for example, FIG. 6 of PTL 1, the fixture extends in a horizontal direction, and includes a substrate portion (fixing plate) that is fixed over a range of a plurality of vertical support bodies. The joint filler extends in an up-down direction, and is fixed to the vertical support bodies.

By disposing the joint filler between the left and right exterior wall plates, transverse displacement of the left and right exterior wall plates is prevented.

The fixture (first securing metal fitting) that is disclosed in PTL 2 can be provided with a contact fitting (transverse displacement prevention metal fitting). The fixture extends in a horizontal direction, and includes an upper horizontal portion that is fixed to a metal backing member having the shape of a square wave. The contact fitting is such that the mounting portion includes an upper fixing plate and a lower fixing plate. By the fixture, the upper fixing plate is fixable to the metal backing and the lower fixing plate is fixable to the fixture, and at least one of the upper fixing plate and the lower fixing plate is fixed so as to extend through the metal backing. By disposing the contact fitting between facing side end portions of the left and right exterior wall plates, transverse displacement of the left and right exterior wall plates is prevented.

The fixture (securing jig main body) that is disclosed in PTL 3 can be provided with a contact fitting (left-right spacing plate). The fixture extends in a horizontal direction and is such that the substrate portion (rear plate) is fixed over a range of a plurality of backing members. Here, the fixing plate portion (fixing surface plate) to which the contact fitting of the fixture is fixed is formed on a side of the backing member so as to form a step with the substrate portion, and is disposed where the backing member does not exist. By disposing the erect piece (spacing piece) of the contact fitting (left-right spacing plate), fixed to the fixing plate portion, between facing side end portions of the left and right exterior wall plates (exterior wall materials), transverse displacement of the left and right exterior wall plates is prevented.

CITATION LIST

Patent Literature

PTL 1: Japanese Unexamined Patent Application Publication No. 2016-102361

PTL 2: Japanese Unexamined Patent Application Publication No. 2013-11056

PTL 3: Japanese Unexamined Patent Application Publication No. 2003-74167

SUMMARY OF INVENTION

Technical Problem

However, in the fixture described in PTL 1, since it is necessary to dispose the joint filler at a location that overlaps the vertical support bodies, the degree of layout freedom of the joint filler, which functions as a contact fitting, is low, and the degree of construction freedom of the exterior wall plates is not good. Here, the so-called "degree of layout freedom" refers to the degree of freedom in selecting the mounting position of the contact fitting with respect to a horizontal direction of the fixture, that is, a horizontal direction of the exterior wall plates. In addition, since construction for fixing the joint filler is always carried out on the vertical support materials, when the joint filler is fixed to the vertical support materials with a fastener, such as a screw, the strength and the durability of the vertical support materials may be reduced.

In the contact fitting described in PTL 2, since the contact fitting can be fixed to at least one of the metal backing member and the fixture, the degree of layout freedom of the contact fitting is higher than that in the fixture described in PTL 1. However, the procedure and content of the work differ when the lower fixing plate of the contact fitting is fixed to the upper horizontal portion of the fixture from when the upper fixing plate is fixed to the metal backing member, so that construction work tends to be complicated. Therefore, constructability is poor. In addition, since the fastener for fixing the contact fitting is fixed so as to extend through the metal backing, the strength and the durability of the backing may be reduced.

In the fixture described in PTL 3, since the contact fitting (left-right spacing plate) cannot be disposed at a location that overlaps the backing member, the degree of layout freedom of the contact fitting is low, and constructability of the exterior wall plates is not good. In addition, since the fixing plate portion (fixing surface plate) is formed on the side of the backing member so as to form a step with the substrate portion (rear plate), when a tapping screw screwed into the fixing plate portion for fixing the contact fitting is too long, the distal end of the tapping screw may damage a waterproof sheet or a column. Therefore, the waterproof property of the waterproof sheet and the strength and the durability of the column may be reduced.

The present invention has been made in view of the circumstances above of the related art, and an object of the present invention is to provide a fixture that can increase the degree of layout freedom of a contact fitting and facilitate construction and that can suppress a reduction in the strength and the durability of a building structure, and to provide a wall structure for buildings.

Solution to Problem

A fixture of a first embodiment of the present invention is capable of be provided with a contact fitting and is provided for mounting a wall material on a bolding structure, the fixture including:

a substrate portion that is fixable to the building structure;

a first side wall portion that protrudes with respect to the substrate portion from one of side edges of the substrate portion;

a second side wall portion that protrudes from another of the side edges of the substrate portion towards a side that is same as a side towards which the first side wall portion protrudes;

a support portion that extends from a distal edge of the first side wall portion so as to face the substrate portion, and that approaches the second side wall portion;

a first locking portion that protrudes from the support portion towards a side opposite to the substrate portion, and that is bent towards a side of the first side wall portion;

a second locking portion that protrudes from the support portion towards the side opposite to the substrate portion, and that is bent towards a side of the second side wall portion; and a fixing plate portion that extends from a distal edge of the second side wall portion so as to face the substrate portion, and that is disposed at a location closer than the support portion to the substrate portion, wherein the contact fitting includes a mounting portion that, in contact with the fixing plate portion from the side opposite to the substrate portion, is fixable to the fixing plate portion, and an erect piece that is erect in a direction that intersects the mounting portion and that protrudes towards the side opposite to the substrate portion.

In the fixture of the first embodiment, the fixing plate portion can extend along the substrate portion without being restricted by, for example, the uneven shape of the building structure and the location of, for example, a furring strip that constitutes the building structure. Therefore, it is possible to fix the mounting portion of the contact fitting at any location on the fixing plate portion.

Regardless of where the mounting portion of the contact fitting is fixed to the fixing plate portion, the procedure and content of the work are the same, so that the construction work is simplified.

Further, a fastening member, such as a screw, for fixing the contact fitting to the fixing plate portion is disposed apart from the substrate portion by a certain amount due to the length of the second side wall portion. Therefore, since the distal end of the fastening member is unlikely to damage a waterproof sheet and a column, it is possible to suppress a reduction in the waterproof property of the waterproof sheet and a reduction in the strength and the durability of the column.

Therefore, in the fixture of the first embodiment of the present invention, it is possible to increase the degree of layout freedom of the contact fitting and to facilitate construction, and to suppress a reduction in the strength and the durability of the building structure.

As a second embodiment of the present invention, it is desirable that the contact fitting include a restricting portion that protrudes from the mounting portion in a direction opposite to the erect piece, and that is contactable with a distal edge of the fixing plate portion.

In this case, by bringing the restricting portion of the contact fitting into contact with the distal end portion of the fixing plate portion of the fixture, the restricting portion helps to position the contact fitting. Therefore, construction work of an exterior wall plate is facilitated.

As a third embodiment of the present invention, it is desirable that the contact fitting include a facing piece that extends from the restricting portion so as to face the mounting portion, and that forms a gap between the facing piece and the mounting portion, a size of the gap being substantially equal to a plate thickness of the fixing plate portion.

In this case, by bringing the mounting portion of the contact fitting into contact with the fixing plate portion, bringing the restricting portion into contact with the distal edge of the fixing plate portion, and interposing the fixing plate portion between the mounting portion and the facing piece, the contact fitting can be easily positioned at the fixing plate portion of the fixture and temporarily fixed. Therefore, it is possible to easily and safely fix the contact fitting to the fixing plate portion by the fastening member.

As a fourth embodiment of the present invention, it is desirable that the contact fitting include a protruding piece that protrudes from the restricting portion in a direction opposite to the facing piece.

In this case, by holding the protruding piece of the contact fitting, a worker can easily bring the mounting portion of the contact fitting into contact with the fixing plate portion of the fixture, can easily bring the restricting portion into contact with the distal edge of the fixing plate portion, and can easily interpose the fixing plate portion between the mounting portion and the facing piece.

As a fifth embodiment of the present invention, it is desirable that the fixture have a through hole that is formed in, of the first side wall portion and the second side wall portion, at least the first side wall portion.

In this case, since, in the vicinity of the fixture, ventilation can be maintained and rainwater or the like can flow downward due to a space between a rear surface of an exterior wall plate and the fixing plate portion and due to the through hole, it is possible to suppress a reduction in the strength and the durability of the exterior wall plate and the building structure.

As a sixth embodiment of the present invention, it is desirable that the second side wall portion be inclined so as to approach the first side wall portion with decreasing distance to a side of the fixing plate portion from a side of the substrate portion.

In this case, since, for example, rainwater that has reached the second side wall portion from the building structure is allowed to flow in a direction away from the building structure due to the inclination, it is possible to suppress deterioration of the building structure.

As a seventh embodiment of the present invention, it is desirable that a slit that is recessed from a distal edge towards the support portion be formed in at least one of the first locking portion and the second locking portion.

In this case, even if at least one of the first locking portion and the second locking portion is locally deformed, it is possible to suppress the deformation from influencing the entire fixture by the slit.

As a result, it is possible to suppress torsional deformation of the fixture. In addition, when slits are formed at a certain interval, it is possible to easily measure the length of the fixture on the basis of, for example, the number of slits and the positional relationship between each slit and an end portion of the fixture.

A wall building structure for buildings according to an eighth embodiment of the present invention is a wall structure in which a wall material is mounted on a building structure by using a fixture that is capable of being provided with a contact fitting, wherein the fixture includes a substrate portion that is fixable to the building structure;

a first side wall portion that protrudes with respect to the substrate portion from one of side edges of the substrate portion, a second side wall portion that protrudes from another of the side edges of the substrate portion towards a side that is same as a side towards which the first side wall portion protrudes, a support portion that extends from a distal edge of the first side wall portion so as to face the substrate portion, that approaches the second side wall portion, and that is capable of supporting a rear surface of the wall material, a first locking portion that protrudes from the support portion towards a side opposite to the substrate portion, that is bent towards a side of the first side wall portion, and that is capable of locking one end portion of the wall material, a second locking portion that protrudes from the support portion towards the side opposite to the substrate portion, that is bent towards a side of the second side wall portion, and that is capable of locking another end portion of the wall material, and a fixing plate portion that extends from a distal edge of the second side wall portion so as to face the substrate portion, and that is disposed at a location closer than the support portion to the substrate portion, wherein the contact fitting includes a mounting portion that, in contact with the fixing plate portion from the side opposite to the substrate portion, is fixable to the fixing plate portion, and an erect piece that is erect in a direction that intersects the mounting portion, that, in a state in which the mounting portion is in contact with the fixing plate portion, protrudes towards the side opposite to the substrate portion, and that is capable of contacting a side end portion of the wall material.

According to the wall structure for buildings of the eighth embodiment of the present invention, due to the operational effects provided by the fixture of the first embodiment, it is possible to increase the degree of layout freedom of the contact fitting and to facilitate construction, and to suppress a reduction in the strength and the durability of the building structure.

A fixture according to a ninth embodiment of the present invention is a fixture for mounting a wall material on a building structure, the fixture including:

a substrate portion;

a first side wall portion that protrudes with respect to the substrate portion from one of side edges of the substrate portion;

a second side wall portion that protrudes from another of the side edges of the substrate portion towards a side that is same as a side towards which the first side wall portion protrudes;

a support portion that extends from a distal edge of the first side wall portion so as to face the substrate portion, and that approaches the second side wall portion;

a first locking portion that protrudes from the support portion towards a side opposite to the substrate portion, and that is bent towards a side of the first side wall portion;

a second locking portion that protrudes from the support portion towards the side opposite to the substrate portion, and that is bent towards a side of the second side wall portion; and a fixing plate portion that extends from a distal edge of the second side wall portion so as to face the substrate portion, and that is disposed at a location closer than the support portion to the substrate portion.

In the fixture of the ninth embodiment, the fixing plate portion having the above-described structure can extend along the substrate portion without being restricted by, for example, the uneven shape of the building structure and the location of, for example, a furring strip that constitutes the building structure. Therefore, an additional member, such as a member for preventing transverse displacement of the wall material, can be easily fixed to any location on the fixing plate portion.

Further, a fastening member, such as a screw, for fixing such an additional member to the fixing plate portion is disposed on a side opposite to the building structure with respect to the substrate portion. Therefore, since the distal end of the fastening member is unlikely to damage the waterproof sheet and the column, it is possible to suppress a reduction in the waterproof property of the waterproof sheet and a reduction in the strength and the durability of the column.

Therefore, in the fixture of the ninth embodiment of the present invention, it is possible to facilitate construction and to suppress a reduction in the strength and the durability of the building structure.

Advantageous Effects of Invention

In the fixture and the wall structure for buildings of the present invention, it is possible to increase the degree of layout freedom of the contact fitting and to facilitate construction, and to suppress a reduction in the strength and the durability of the building structure.

DESCRIPTION OF EMBODIMENTS

Figure 1:
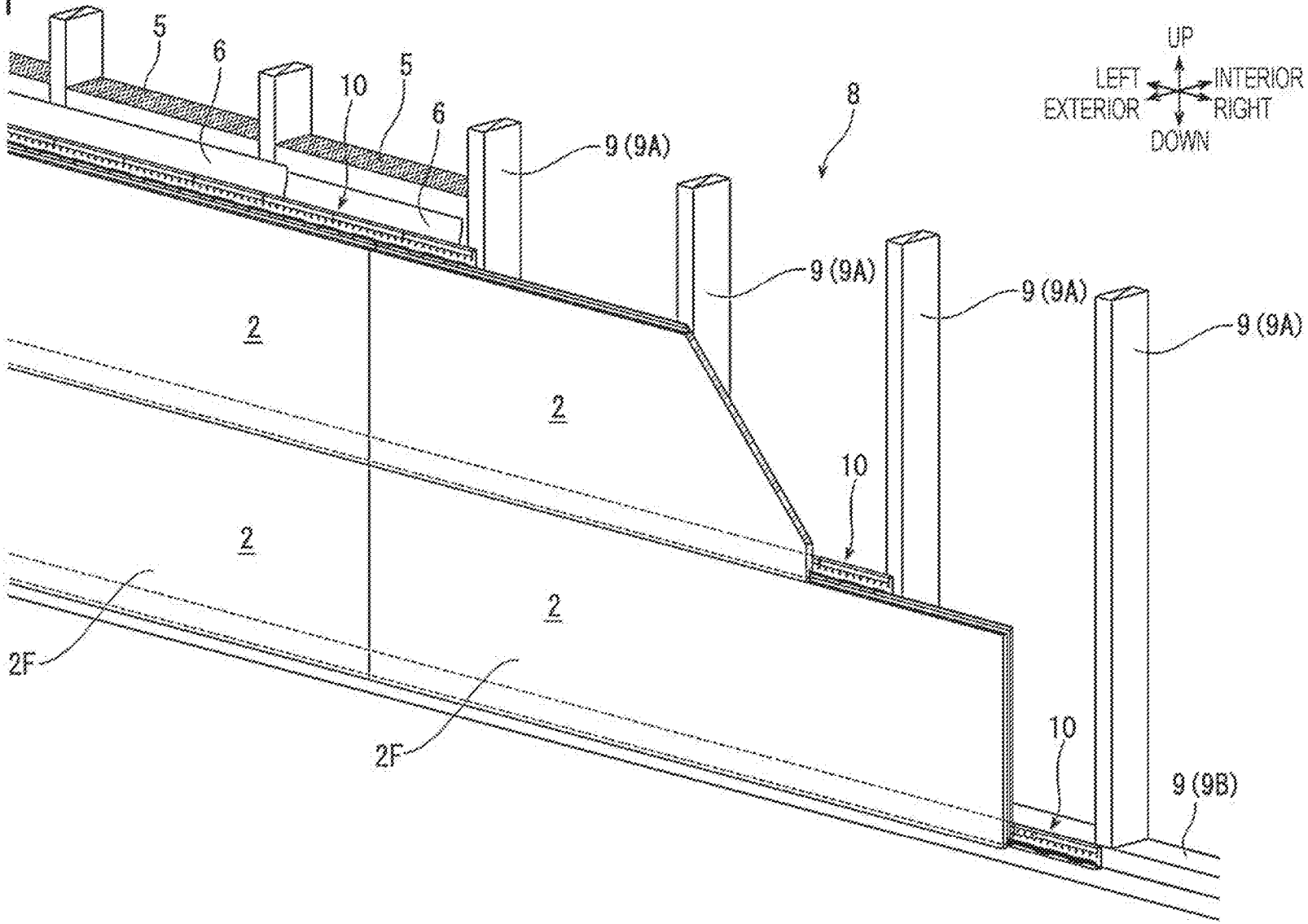
FIG. 1 is a perspective view of a wall structure for buildings of a first embodiment.
Figure 2:
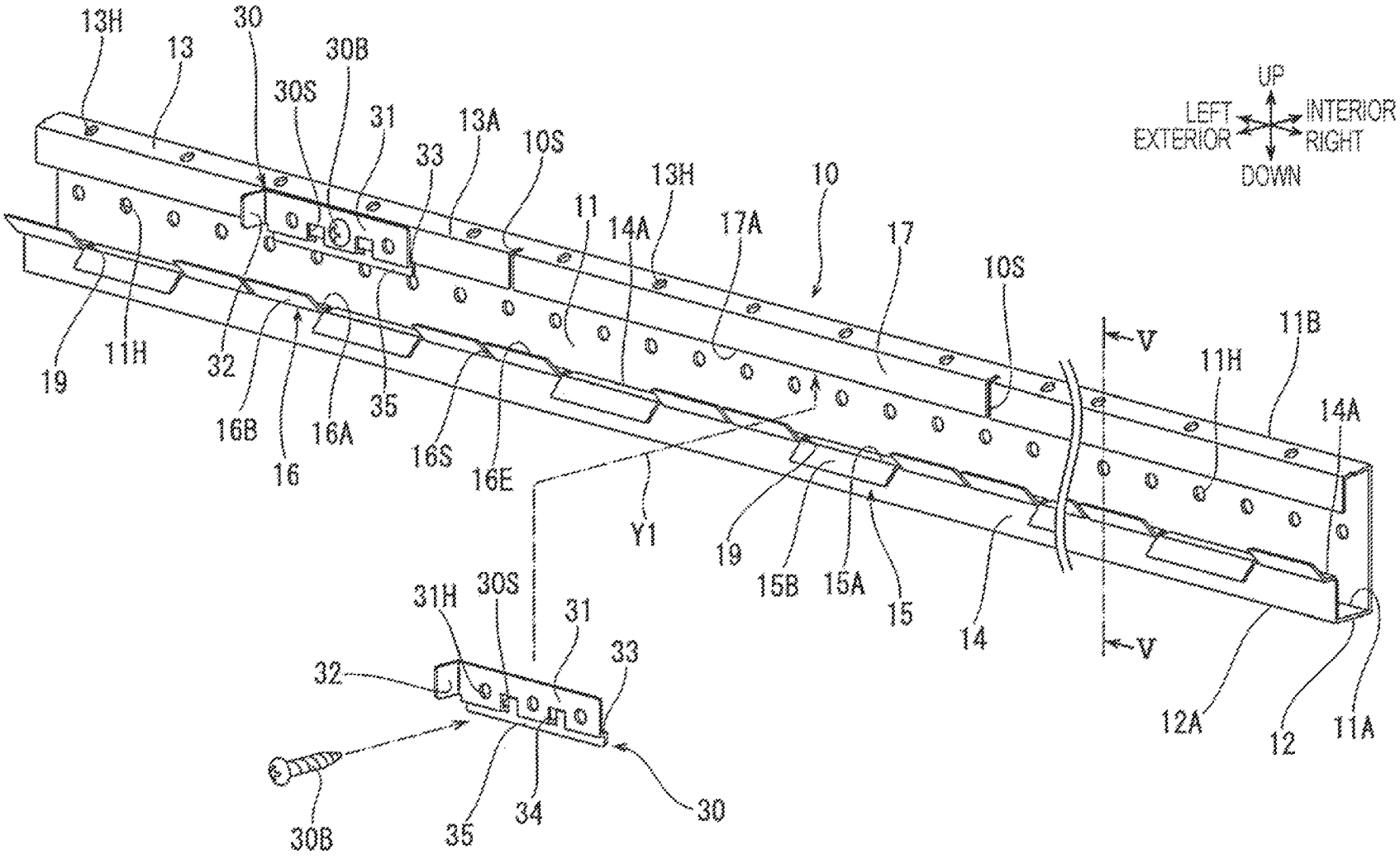
FIG. 2 is a perspective view showing a fixture of the first embodiment and a contact fitting provided at the fixture.

First and second embodiments, which are embodiments of the present invention, are described with reference to the drawings. In FIG. 1, a vertical upward direction indicates "up", and a vertical downward direction indicates "down". In addition, in a direction from the exterior to the interior in FIG. 1, a horizontal leftward direction indicates "left", and a horizontal rightward direction indicates "right". In FIG. 2 and the figures that follow, the directions indicated in each figure are shown to correspond with those indicated in FIG. 1.

First Embodiment

As shown in FIG. 1, a wall structure of the first embodiment is an example of a specific embodiment of the wall structure. The wall structure is one in which, by using fixtures 10, a plurality of exterior wall plates 2 are mounted on a building structure 8 that constitutes a building, such as a house, a facility, or a storehouse. Each exterior wall plate 2 is an example of a wall material. As shown in, for example, FIGS. 3 and 4, each exterior wall plate 2, itself, has high strength and rigidity, and is a wall material that constitutes an exterior wall of a building. Each wall material is not limited to an exterior wall plate, and may be, for example, a façade board that constitutes the exterior of the building, an interior structural panel, or an interior plate.

As shown in FIG. 1, the building structure 8 is, for example, constructed by a wooden framework construction method. The building structure 8 is constituted by a plurality of structural members. The structural members include column members 9 including, for example, a plurality of column materials 9A that are arranged side by side and apart from each other at a predetermined interval in a left-right direction, a column material 9B that is connected to a lower end of each column material 9A and that forms a foundation, and studs that are disposed between the column materials 9A and the column material 9B. An insulating material 5 is provided between each of the column members 9. A waterproof sheet 6 is placed on a surface of the insulating material 5. Depending upon, for example, the construction state of the building structure 8, it is also possible to omit the insulating material 5 and the waterproof sheet 6. The building structure 8 is not limited to the structure of the present embodiment, and may be, for example, a framework, such as a steel construction, a reinforced concrete construction, a brick construction, or the like.

The fixtures 10 of the first embodiment are disposed between the column members 9 and the exterior wall plates 2. The fixtures 10 are mounted on the corresponding column members 9 so as to be disposed apart from each other at a predetermined interval in an up-down direction, and so as to extend in a left-right direction. Each fixture 10 is an example of a specific form of a fixture. As shown in, for example, FIGS. 2 and 4, each fixture 10 is a long metal member. Each fixture 10 is manufactured by, for example, bending and pressing a metal plate material. The material and the manufacturing method of each fixture 10 are not limited to the above, and, thus, can be appropriately selected from various materials and various manufacturing methods.

In the following description of the shape of each fixture 10 below, regarding the up-down directions, the left-right directions, and interior-exterior directions, the orientation of the fixtures 10 fixed to the column members 9 serves as a reference.

As shown in FIG. 2, each fixture 10 includes a substrate portion 11, a first side wall portion 12, a second side wall portion 13, a support portion 14, first locking portions 15, second locking portions 16, and a fixing plate portion 17.

The substrate portion 11 has a rectangular shape that is longer in length in the left-right direction than in the up-down direction.

Although the length of the substrate portion 11 in the left-right direction is, for example, approximately 1.8 m, it may be longer or shorter in length than approximately 1.8 m. The substrate portion 11 is used by cutting it as appropriate in accordance with a construction location. A plurality of fixing holes 11H are formed in the substrate portion 11 at a predetermined interval in the left-right direction so as to extend through the substrate portion 11 in the interior-exterior direction. Each fixing hole 11H is disposed in substantially the center of the substrate portion 11 in the up-down direction. A surface of the substrate portion 11 facing the interior direction is a flat surface that is capable of contacting the column members 9.

Figure 5:
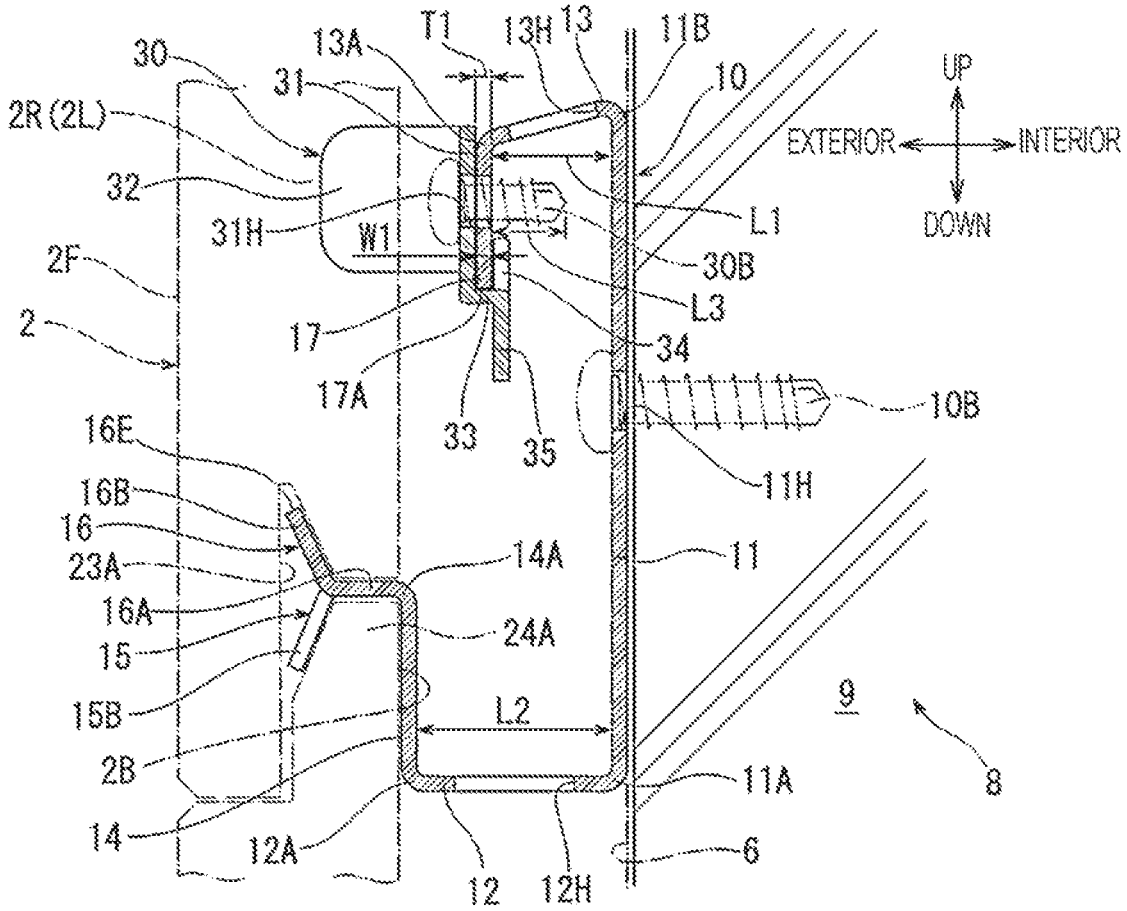
FIG. 5 is a partial sectional view showing a cross section along V-V in FIG. 2.

As shown in FIG. 5, the substrate portion 11 extending in the left-right direction is in contact with each column member 9, and a screw 10B, which is an example of fastening means, is passed through any fixing hole 11H, so that the substrate portion 11 is fastened to each column member 9.

In this way, the substrate portion 11 of the fixture 10 is fixed over a range of the column members 9. When fixing the fixture 10 to each column member 9, the fixing holes 11H allow fixing positions thereof to be determined and positional displacements thereof to be suppressed to facilitate the work.

As shown in FIGS. 2 and 5, the first side wall portion 12 has a rectangular shape that is bent at substantially right angles from a lower edge 11A of the substrate portion 11, protrudes in the exterior direction, and extends in the left-right direction. The lower edge 11A of the substrate portion 11 is an example of one of side edges of the substrate portion. A plurality of through holes 12H are formed in the first side wall portion 12 at a predetermined interval in the left-right direction so as to extend through the first side wall portion 12 in the up-down direction.

The second side wall portion 13 has a rectangular shape that is bent from an upper edge 11B of the substrate portion 11, protrudes in the exterior direction, and extends in the left-right direction. The upper edge 11B of the substrate portion 11 is an example of another of the side edges of the substrate portion. The second side wall portion 13 is inclined downward so as to approach the first side wall portion 12 with increasing distance from the substrate portion 11. A plurality of through holes 13H are formed in the second side wall portion 13 at a predetermined interval in the left-right direction so as to extend through the second side wall portion 13 in the up-down direction.

The support portion 14 extends upward so as to approach the second side wall portion 13 while being bent at substantially right angles from a distal edge 12A of the first side wall portion 12 and facing the substrate portion 11. The support portion 14 has a rectangular shape that is longer in length in the left-right direction than in the up-down direction. The support portion 14 is substantially parallel to the substrate portion 11. A surface of the support portion 14 facing the exterior direction is a flat surface that is capable of contacting rear surfaces 2B of exterior wall plates 2.

As shown in FIG. 2, the first locking portions 15 and the second locking portions 16 are alternately disposed side by side in the left-right direction, and are connected to an upper edge 14A of the support portion 14. The first locking portions 15 and the second locking portions 16 are separated from each other by slits 19.

Each first locking portion 15 includes a first support piece 15A and a first locking piece 15B. The first support piece 15A is bent at substantially right angles from the upper edge 14A of the support portion 14 and protrudes in the exterior direction. The first locking piece 15B is bent towards a side of the first side wall portion 12 from a distal edge of the first support piece 15A and is inclined downward.

Each second locking portion 16 includes a second support piece 16A and a second locking piece 16B. The second support piece 16A is bent at substantially right angles from the upper edge 14A of the support portion 14 and protrudes in the exterior direction. The second locking piece 16B is bent towards a side of the second side wall portion 13 from a distal edge of the second support piece 16A and is inclined upward.

A slit 16S is formed in each second locking portion 16 so as to be situated at substantially the center of each second locking portion 16 in the left-right direction. Each slit 16S is recessed from a distal edge 16E of its corresponding second locking piece 16B to the distal edge of its corresponding second support piece 16A.

As shown in FIGS. 2 and 5, the fixing plate portion 17 extends downward so as to approach the first side wall portion 12 while being bent at substantially right angles from a distal edge 13A of the second side wall portion 13 and facing the substrate portion 11. The fixing plate portion 17 has a rectangular shape that is longer in length in the left-right direction than in the up-down direction. The fixing plate portion 17 is substantially parallel to the substrate portion 11.

A separation length of the fixing plate portion 17 from the substrate portion 11 in the exterior direction is L1, and a separation length of the support portion 14 from the substrate portion 11 in the exterior direction is L2. The length L1 is set smaller than the length L2. That is, the fixing plate portion 17 is disposed at a location closer than the support portion 14 to the substrate portion 11.

Figure 4:
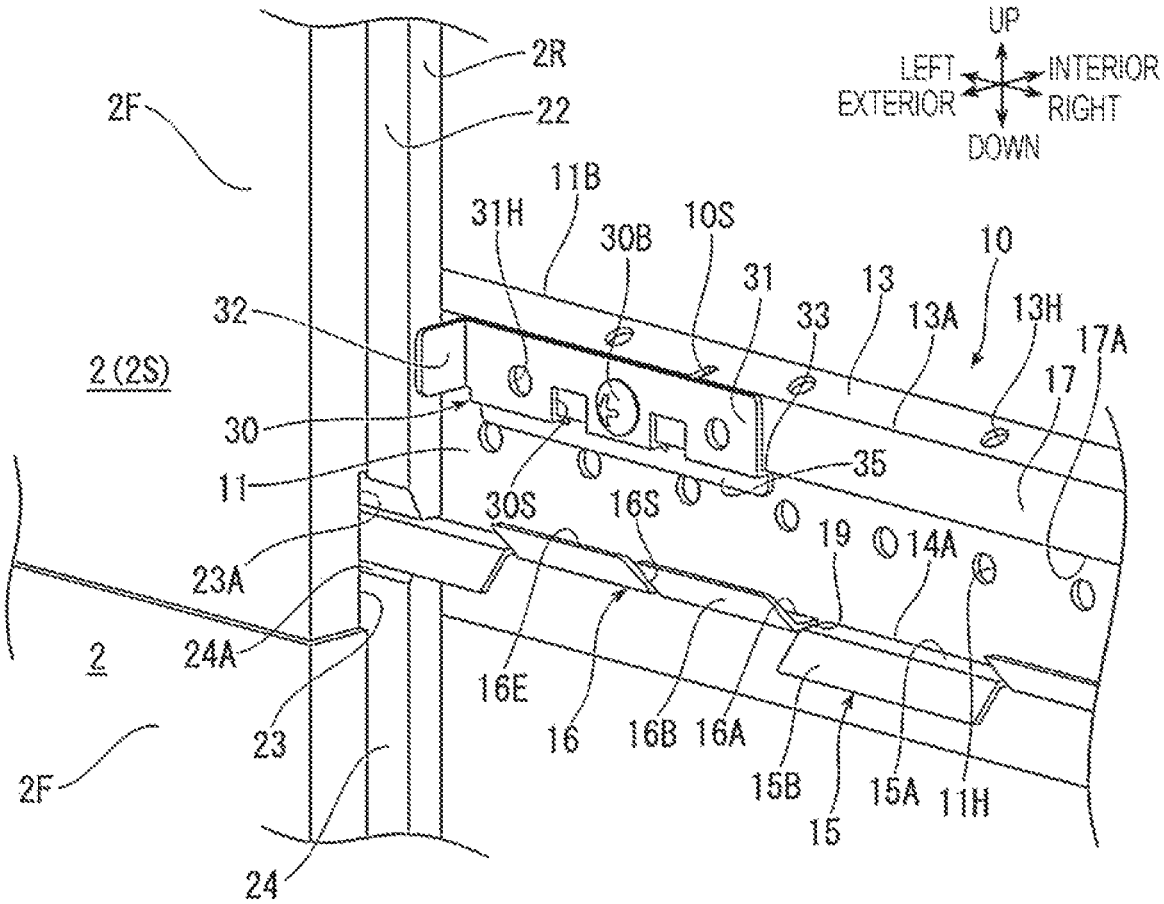
FIG. 4 is a partial perspective view showing a state in which exterior wall plates are supported by the fixture and the contact fitting according to the first embodiment.

As shown in FIGS. 2 and 4, a plurality of slits 10S are formed in the fixing plate portion 17 and the second side wall portion 13 at a predetermined interval in the left-right direction. Each slit 10S is recessed from a lower edge 17A of the fixing plate portion 17 to the distal edge 13A of the second side wall portion 13, and is further recessed up to substantially the center of the second side wall portion 13 in the interior-exterior direction. The lower edge 17A of the fixing plate portion 17 is an example of a distal edge of the fixing plate portion.

Each fixture 10 can be provided with a contact fitting 30. The contact fitting 30 is manufactured by, for example, bending and pressing a metal plate material. The material and the manufacturing method of the contact fitting 30 are not limited to the above, and, thus, can be appropriately selected from various materials and various manufacturing methods.

In the following description of the shape of the contact fitting 30 below, regarding the up-down directions, the left-right directions, and the interior-exterior directions, the orientation of the contact fitting 30 fixed to the fixture 10 serves as a reference.

As shown in FIG. 2 and FIGS. 4 to 7, the contact fitting 30 includes a mounting portion 31, an erect piece 32, a restricting portion 33, a facing piece 34, and a protruding piece 35.

The mounting portion 31 has a substantially rectangular shape that is longer in length in the left-right direction than in the up-down direction. A surface of the mounting portion 31 facing the interior direction is a flat surface that is capable of contacting a surface of the fixing plate portion 17 facing the exterior direction.

Three fixing holes 31H are formed in the mounting portion 31 at a predetermined interval in the left-right direction so as to extend through the mounting portion 31 in the interior-exterior direction. When fixing the contact fitting 30 to the fixture 10, the fixing holes 31H allow fixing positions thereof to be determined and positional displacements thereof to be suppressed to facilitate the work.

The erect piece 32 is a substantially rectangular piece that is bent at substantially right angles from a left edge of the mounting portion 31, protrudes in the exterior direction, and extends in the up-down direction.

The restricting portion 33 is bent at substantially right angles from a lower edge of the mounting portion 31, protrudes in the interior direction, and extends in the left-right direction. An upper surface of the restricting portion 33 is a flat surface that is capable of contacting the lower edge 17A of the fixing plate portion 17.

The protruding piece 35 is bent at substantially right angles from an interior-side edge of the restricting portion 33 and extends downward. The protruding piece 35 has a rectangular shape that is longer in length in the left-right direction than in the up-down direction.

Two substantially C-shaped slits 30S are formed, each between the corresponding fixing holes 31H at the mounting portion 31 and the restricting portion 33. The facing piece 34 is formed by causing portions that are surrounded by the slits 30S to separate from the mounting portion 31 in the interior direction by bending the restricting portion 33 and the protruding piece 35. The facing piece 34 extends upward rom the restricting portion 33 in a direction opposite to the protruding piece 35 so as to face the mounting portion 31. A surface of the facing piece 34 facing the exterior direction is a flat surface that is capable of contacting a sur ace of the fixing plate portion 17 facing the interior direction.

Figure 7:
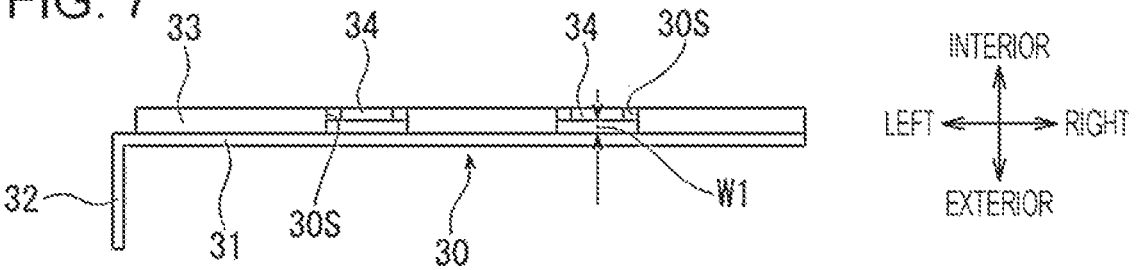
FIG. 7 is a top view of the contact fitting according to the first embodiment.

As shown in FIG. 5, a plate thickness of the fixing plate portion 17 is T1. As shown in FIG. 7, a gap formed between the facing piece 34 and the mounting portion 31 is W1. A size of the gap W1 is set substantially equal to the plate thickness T1.

As shown by arrow Y1 in FIG. 2, the contact fitting 30 is brought close to the fixing plate portion 17 of the fixture 10 and, at a location that is displaced downward from the fixing plate portion 17, the surface of the mounting portion 31 facing the interior direction is brought into contact with the surface of the fixing plate portion 17 facing the exterior direction. Then, the contact fitting 30 is displaced upward and the lower edge 17A of the fixing plate portion 17 of the fixture 10 is inserted into the gap W1 between the mounting portion 31 and the facing piece 34 of the contact fitting 30. Therefore, as shown in FIGS. 2, 4, and 5, the fixing plate portion 17 is interposed between the mounting portion 31 and the facing piece 34. In addition, the restricting portion 33 of the contact fitting 30 comes into contact with the lower edge 17A of the fixing pate portion 17 from therebelow. Therefore, the contact fitting 30 is no longer inclined with respect to the fixture 10, and is positioned with respect to the fixture 10 in the up-down direction. As a result, the contact fitting 30 is temporarily fixed to the fixing plate portion 17 of the fixture 10. In this state, a screw 30B, which is an example of fastening means, passes through any one of the fixing holes 31H to fasten to the fixing plate portion 17. In this way, the mounting portion 31 of the contact fitting 30 can be fixed to any location on the fixing plate portion 17 of the fixture 10.

As shown in FIG. 5, the separation length L1 of the fixing plate portion 17 from the substrate portion 11 in the exterior direction is set sufficiently larger than a length L3 of a threaded portion of the screw 30B protruding from the fixing plate portion 17 in the interior direction.

Figure 3:
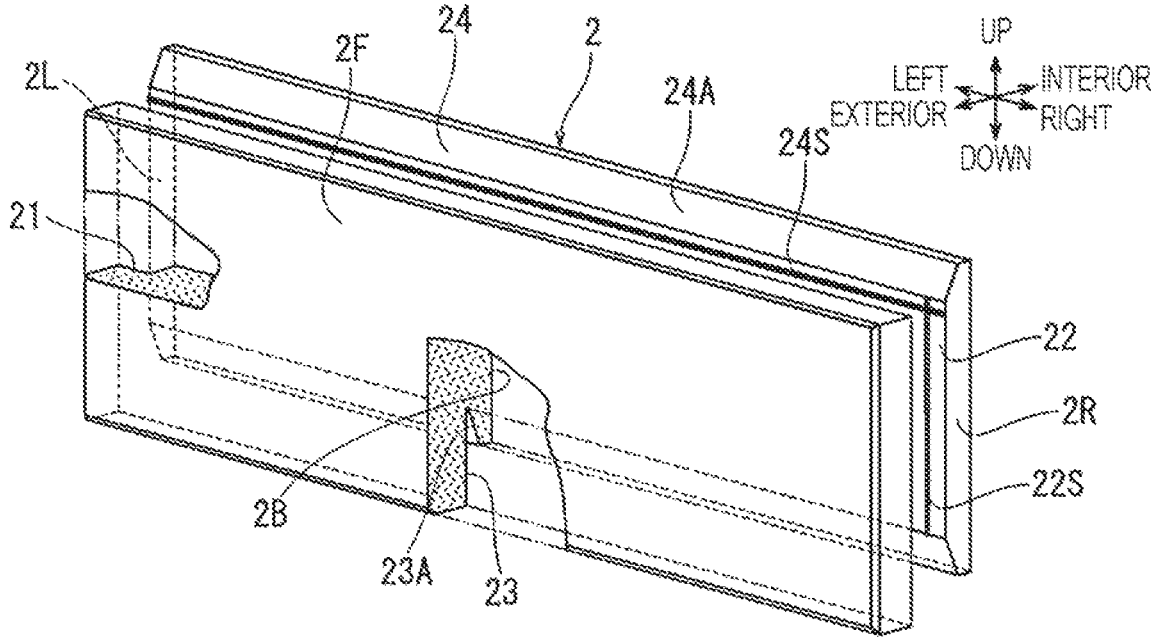
FIG. 3 is a perspective view of an exterior wall plate according to the first embodiment.

As shown in FIG. 3, each exterior wall plate 2 is a plate material having a quadrilateral shape, more specifically, a substantially rectangular shape that is long in the left-right direction. In the present embodiment, each exterior wall plate 2 is made of a ceramic-based material including cement. The material and shape of each exterior wall plate 2 are not limited to those mentioned above. For example, the material of each exterior wall plate 2 can be selected s appropriate from metal-based materials, wood-based materials, and resin-based materials.

The shape of each exterior wall plate 2 can be selected as appropriate from, for example, substantially rectangular plate materials having a quadrilateral shape and being long in the up-down direction.

A front surface 2F of each exterior wall plate 2 is, for example, an exterior surface that is designed with a brick pattern.

A front-side left-right joining portion 21 is formed on a left end portion of the corresponding exterior wall plate 2. A rear-side left-right joining portion 22 is formed on a right end portion of the corresponding exterior wall plate 2. A front-side up-down joining portion 23 is formed on a lower end portion of the corresponding exterior wall plate 2. A rear-side up-down joining portion 24 is formed on an upper end portion of the corresponding exterior wall plate 2. FIG. 2 exaggeratedly shows the sizes of the front-side left-right joining portion 21, the rear-side left-right joining portion 22, the front-side up-down joining portion 23, and the rear-side up-down joining portion 24 with respect to the size of the corresponding exterior wall plate 2.

The front-side left-right joining portion 21 is recessed towards the front surface 2F from the rear surface 2B of the corresponding exterior wall plate 2, and extends in the up-down direction, that is, along the left end portion of the corresponding exterior wall plate 2.

The rear-side left-right joining portion 22 is recessed towards the rear surface 2B from the front surface 2F of the corresponding exterior wall plate 2, and extends in the up-down direction, that is, along the right end portion of the corresponding exterior wall plate 2. A caulk 22S is provided on a flat surface of the rear-side left-right joining portion 22 facing the exterior direction. The caulk 22S is linearly disposed along the rear-side left-right joining portion 22. Caulking need not be performed, so that the caulk 22S can be omitted.

The front-side up-down joining portion 23 is recessed towards the front surface 2F from the rear surface 2B of the corresponding exterior wall plate 2, and extends in the left-right direction, that is, along the lower end portion of tree corresponding exterior wall plate 2. An engaging recessed portion 23A that is recessed upward in a substantially tapering form is formed in the front-side up-down joining portion 23.

The rear-side up-down joining portion 24 is recessed towards the rear surface 2B from the front surface 2F of the corresponding exterior wall plate 2, and extends in the left-right direction, that is, along the upper end portion of the corresponding exterior wall plate 2. A caulk 24S is provided on a flat surface of the rear-side up-down joining portion 24 facing the exterior direction. The caulk 24S is linearly disposed along the rear-side up-down joining portion 24. Caulking need not be performed, so that the caulk 24S can be omitted. At a location above the caulk 24S, an engaging protruding piece 24A that protrudes upward in a substantially tapering form is formed in the rear-side up-down joining portion 24.

As shown in FIG. 4, when the rear-side up-down joining portion 24 of a lower exterior wall plate 2 and the front-side up-down joining portion 23 of an upper exterior wall plate overlap each other, an up-down shiplap portion extending in the left-right direction is formed between exterior wall plates 2 adjacent to each other in the up-down direction. Although not shown, when the front-side left-joining portion 21 of a right exterior or wall plate 2 and the rear-side left-right joining portion 22 of a left exterior wall plate 2 overlap each other, a left-right portion extending in the up-down direction is formed between the exterior wall plates 2 that are adjacent to each other in the left-right direction. That is, each exterior wall plate 2 is a plate material that is a so-called four-side shiplap structure including the front-side left-right joining portion 21, the rear-side left-right joining portion 22, the front-side up-down joining portion 23, and the rear-side up-down joining portion 24.

As shown in FIGS. 1, 4, and 5, the exterior wall plates 2 are mounted on the building structure 8 by the fixtures 10 in the following way.

As shown in FIG. 1, first, a plurality of fixtures 10 are mounted on the bottommost locations of corresponding column members 9 so as to extend in the left-right direction. Then, a plurality of exterior wall plates 2 are mounted on the fixtures 10 so as to be adjacent to each other in the left-right direction. Here, as shown in FIG. 5, the lower end portions of the exterior wall plates 2 are supported by the fixtures 10 by locking the engaging recessed portions 23A by the second locking portions 16 of the fixtures 10.

Next, as shown in FIG. 1, a different plurality of fixtures 10 are mounted on these exterior wall plates 2 from thereabove so as to extend in the left-right direction. Here, as shown in FIGS. 4 and 5, the upper end portions of these exterior wall plates 2 are supported by the fixtures 10 by locking the engaging protruding pieces 24A by the first locking portions 15 of the fixtures 10.

Further, a plurality of exterior wall plates 2 are mounted on the fixtures 10 from thereabove so as to be adjacent to each other in the left-right direction. Even in this case, as shown in FIG. 5, the lower end portions of the exterior wall plates 2 are mounted on the fixtures 10 by locking the engaging recessed portions 23A by the second locking portions 16 of the fixtures 10.

Here, the fixtures 10 are used when mounting the plurality of exterior wall plates 2 so as to be adjacent to each other in the left-right direction. As shown in FIG. 4, with the erect piece 32 being in contact from the right with a right side end portion 2R of a particular exterior wall plate 2 (2S) where the engaging recessed portion 23A is locked by the second locking portion 16 of the fixture 10, the contact fitting 30 is temporarily fixed to the fixing plate portion 17 of the fixture 10, and is fastened to the fixing portion 17 by the screw 30B. Therefore, the particular exterior wall plate 2 (2S) is prevented from being transversely displaced rightward. In addition, although not illustrated, a different exterior wall plate 2 is placed adjacent to the particular exterior wall plate 2 (2S) from the right. Then, a left side end portion 2L of the exterior wall plate 2 (see FIG. 2) is brought into contact with the erect piece 32 from the right. Consequently, the exterior wall plate 2 is prevented from being transversely displaced leftwards.

Accordingly, the fixture 10 supports corner portions of a plurality of exterior wall plates 2 that are abutted against each other, that is, a four-side shiplap portion. By bringing the support portion 14 of the fixture 10 into contact with the rear surfaces 2B of the exterior wall plates 2, a ventilation space is ensured between the a wall surface of the building structure 8 and the rear surfaces 2B of the exterior wall plates 2.

By performing such work on the other exterior wall plates 2, the exterior wall plates 2 that are adjacent to each other in the up-down direction and the left-right direction are supported by the building structure 8, and cover the wall surface of the building structure 8.

<Operational Effects>

In each fixture 10 and the wall structure of the first embodiment, as shown in FIGS. 2, 4, and 5, the fixing plate portion 17 can extend along the substrate portion 11 without being restricted by, for example, the uneven shape of the building structure 8 and the locations of the column members 9 that constitute the building structure 8. Therefore, it is possible to fix the mounting portion 31 of the contact fitting 30 at any location on the fixing plate portion 17.

Regardless of where the mounting portion 31 of the contact fitting 30 is fixed to the fixing plate portion 17 of the corresponding fixture 10, the procedure and content of the work are the same. Therefore, the restricting portion 33 of the contact fitting 30 allows the contact fitting 30 to be no longer inclined with respect to the fixture 10, and the contact fitting 30 to be precisely positioned with respect to the corresponding fixture 10 in the up-down direction. Therefore, the construction work is simplified.

Further, as shown in FIG. 5, due to the length of the second side wall portion 13 in the interior-exterior direction, the screw 30B for fixing the contact fitting 30 to the fixing plate portion 17 is disposed at a location that is separated by a certain amount from the substrate portion 11. In other words, the separation length L1 of the fixing plate portion 17 from the substrate portion 11 in the exterior direction is set sufficiently larger than the length L3 of the threaded portion of the screw 30B protruding from the fixing plate portion 17 in the interior direction. Therefore, since the distal end of the screw 30B is unlikely to damage the waterproof sheet 6 and the column members 9, it is possible to suppress a reduction in the waterproof property of the waterproof sheet 6 and a reduction in the strength and the durability of the column members 9.

Therefore, in each fixture 10 and the wall structure of the first embodiment, it is possible to increase the degree of layout freedom of the contact fitting 30 and to facilitate construction, and to make it possible to suppress a reduction in the strength and the durability of the building structure 8.

As shown in FIGS. 5 and 7, the facing piece 34 extends upward from the restricting portion 33 so as to face the mounting portion 31, and forms the gap W1 that is formed between it and the mounting portion 31 and that has a size substantially equal to the plate thickness T1 of the fixing plate portion 17. Therefore, when the contact fitting 30 is mounted on the fixing plate portion 17 of the corresponding fixture 10, the fixing plate portion 17 is interposed between the mounting portion 31 and the facing piece 34, so that the contact fitting 30 can be easily positioned at the fixing plate portion 17 and temporarily fixed. Therefore, it is possible to easily and safely fix the contact fitting 30 to the fixing plate portion 17 by the screw 30B.

Figure 6:
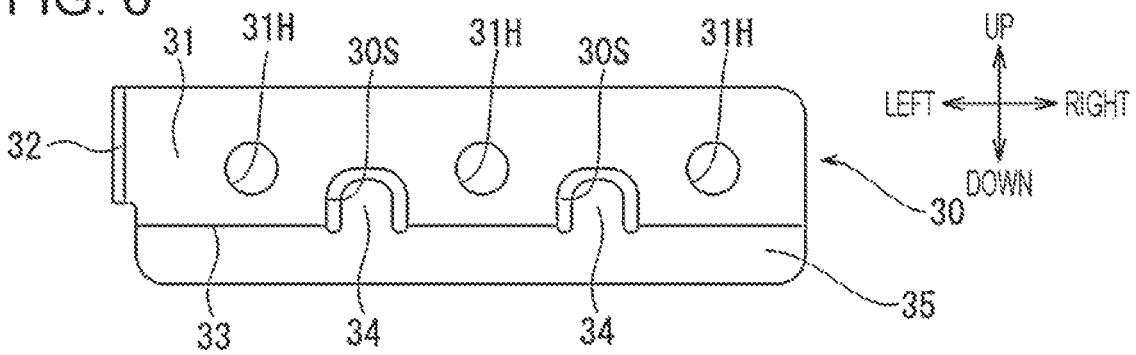
FIG. 6 is a front view of the contact fitting according to the first embodiment.

Further, as shown in FIGS. 5 and 6, the protruding piece 35 protrudes downward from the restricting portion 33 in a direction opposite to the facing piece 34. Therefore, while holding the protruding piece 35 of the contact fitting 30, a worker can easily bring the mounting portion 31 of the contact fitting 30 into contact with the fixing plate portion 17, can easily bring the restricting portion 33 of the contact fitting 30 into contact with the lower edge 17A of the fixing plate portion 17, and can easily interpose the fixing plate portion 17 between the mounting portion 31 and the facing piece 34.

As shown in, for example, FIG. 5, the fixture 10 has the through holes 12K formed in the first side wall portion 12 and the through holes 13H formed in the second side wall portion 13. Therefore, since, in the vicinity of the fixture 10, ventilation can be maintained and rainwater or the like can flow downward due to a space between the rear surface 2B of each exterior wall plate 2 and the fixing plate portion 17 and due to the through holes 12H and 13H, it is possible to suppress a reduction in the strength and the durability of the exterior wall plates 2 and the building structure 8.

Further, the second side wall portion 13 is inclined downward so as to approach the first side wall portion 12 with decreasing distance to a side of the fixing plate portion 17 from a side of the substrate portion 11. Therefore, since, for example, rainwater that has reached the second side wall portion 13 from the building structure 8 is allowed to flow in a direction away from the building structure 8, it is possible to suppress deterioration of the building structure 8.

As shown in, for example, FIG. 4, each slit 16S that is recessed from the distal edge 16E of the second locking piece 16B to the distal edge of the second support piece 16A is formed in the second locking portion 16. Therefore, even if the second locking portion 16 is locally deformed, it is possible to suppress the deformation from influencing the entire fixture 10 by the slits 16S. As a result, it is possible to suppress torsional deformation of the fixture 10. When the slits 16S are formed at a certain interval, it is possible to easily measure the length of the fixture 10 on the basis of, for example, the number of slits 16S and the positional relationship between each slit 16S and an end portion of the fixture 10.

Second Embodiment

Figure 8:
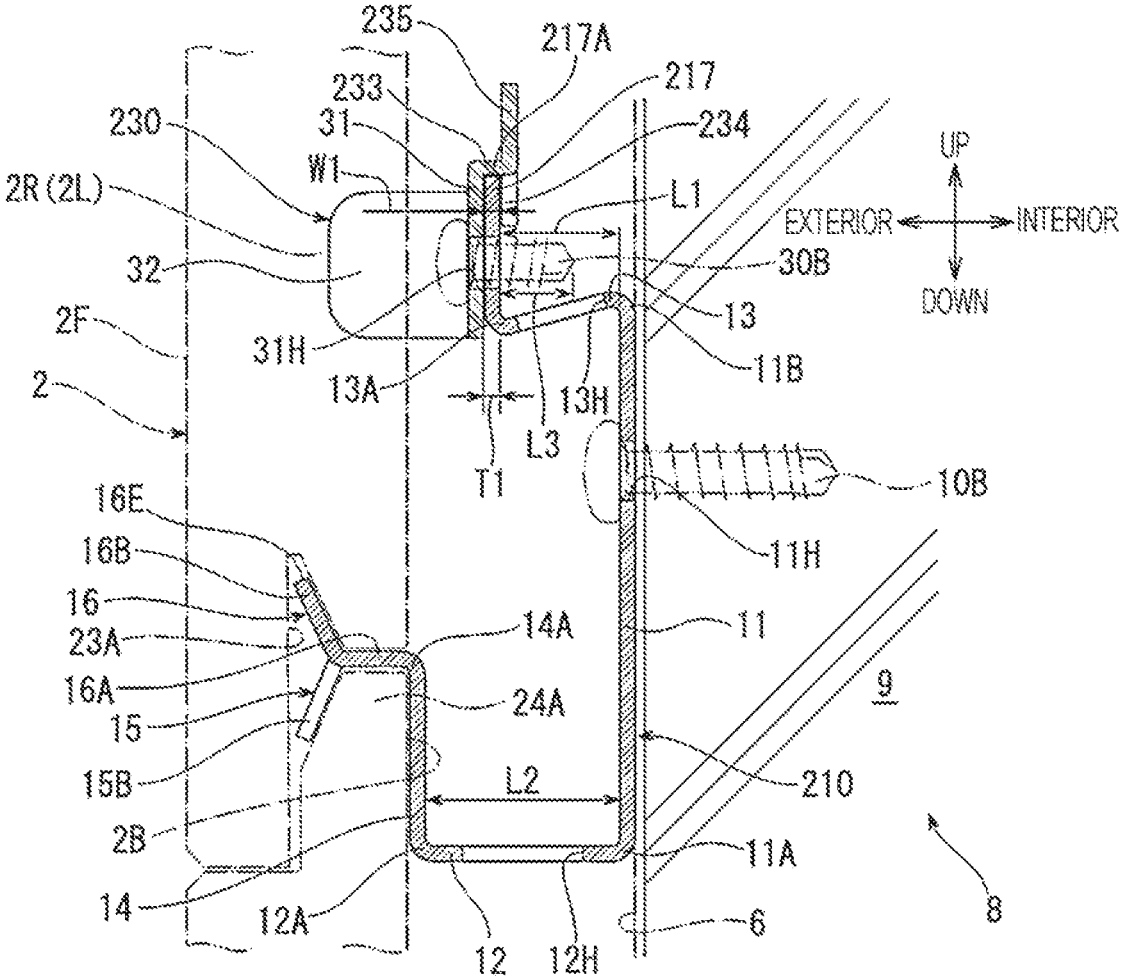
FIG. 8 is a partial sectional view showing a cross section of a wall structure of a second embodiment, the cross section corresponding to that shown in FIG. 5.
Figure 9:
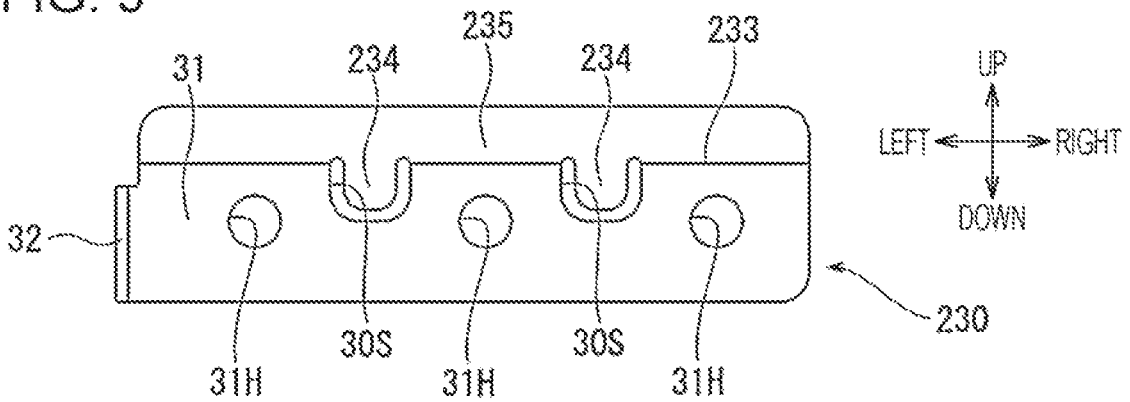
FIG. 9 is a front view of a contact fitting according to the second embodiment.

As shown in FIGS. 8 and 9, in a wall structure of a second embodiment, fixtures 210 are used in place of the fixtures 10 of the first embodiment, and contact fittings 230 are used in place of the contact fittings 30 of the first embodiment. The other structures of the second embodiment are the same as those of the first embodiment. Therefore, structures that correspond to those of the first embodiment are given the same reference numerals, and their descriptions are omitted or simplified.

In each fixture 210, the fixing plate portion 17 of each fixture 10 of the first embodiment is changed to a fixing plate portion 217. The fixing plate portion 217 is bent from a distal edge 13A of a second side wall portion 13 and extends upward and away from a first side wall portion 12. The plate thickness of the fixing plate portion 217 is the same as the plate thickness T1 of the fixing plate portion 17 according to the first embodiment. A separation length of the fixing plate portion 217 from a substrate portion 11 in the exterior direction is the same as the separation length L1 of the fixing plate portion 17 according to the first embodiment from the substrate portion 11 in the exterior direction. The length of a threaded portion of a screw 30B protruding from the fixing plate portion 217 in the interior direction is the same as the length L3 of the threaded portion of the screw 30B according to the first embodiment protruding from the fixing plate portion 17 in the interior direction.

In each contact fitting 230, the restricting portion 33, the facing piece 34, and the protruding piece 35 of the contact fitting 30 of the first embodiment are changed to a restricting portion 233, a facing piece 234, and a protruding piece 235. The restricting portion 33, the facing piece 34, and the protruding piece 35 according to the first embodiment are positioned below the mounting portion 31 and the erect piece 32 that is connected to the left edge of the mounting portion 31. In contrast, the restricting portion 233, the facing piece 234, and the protruding piece 235 differ from the restricting portion 33, the facing 34, and the protruding piece 35 only in that they ace positioned above a mounting portion 31 and an erect piece 32 that is connected to a left edge of the mounting portion 31.

The restricting portion 233 is bent at substantially right angles from an upper edge of the mounting portion 31 and protrudes in the interior direction.

The facing piece 234 extends downward from the restricting portion 233 so as to face the mounting portion 31. The protruding piece 235 is bent at substantially right angles from an interior-side edge of the restricting portion 233, and extends upward in a direction opposite to the facing piece 234. A gap between the facing piece 334 and the mounting portion 31 is the same as the gap W1 between the facing piece 34 and the mounting portion 31 according to the first embodiment. That is, by inserting an upper edge 217A of the fixing plate portion 217 into the gap W1 between the mounting portion 31 and the facing piece 234, it is possible to interpose the fixing plate portion 217 between the mounting portion 31 and the facing piece 234.

Even in each fixture 210 and the wall structure of the second embodiment having such a configuration, similarly to the fixtures 10 and the wall structure of the first embodiment, it is possible to increase the degree of layout freedom of the contact fitting 230 and to facilitate construction, and to suppress a reduction in the strength and the durability of the building structure 8.

Although, in the foregoing description, forms of the present invention are described in accordance with the first and second embodiments, the forms of the present invention are not limited to the first and second embodiments above. Needless to say, the forms can be changed as appropriate within a scope that does not depart from the spirit thereof, and applied.

For example, although, in the first and second embodiments, the slits 16S are formed only in each second locking portion 16, other structures are possible. For example, slits similar to the slits 16S may be formed in each first locking portions 15.

When the second side wall portion 13 is inclined downward so as to approach the first side wall portion 12 with decreasing distance to the side of the fixing plate portion 17 from the side of the substrate portion 11, a structure in which through holes 13H are not formed in the second side wall portion 13 is also included in the present invention. In case, for example, rainwater that has reached the second side wall portion 13 can be collected at a location away from the building structure 8.

REFERENCE SIGNS LIST

8 building structure
2 wall material (exterior wall plate)
2B rear surface of wall material (rear surface of exterior wall plate)
2L, 2R side end portion of wall material (2L left side end portion of exterior wall plate; 2R right side end portion of exterior wall plate)
10, 210 fixture
11 substrate portion
11A one of side edges of substrate portion (lower edge of substrate portion)
11B another of side edges of substrate portion (upper edge of substrate portion)
12 first side wall portion
12A distal edge of first side wall portion
13 second side wall portion
13A distal edge of second side wall portion
14 support portion
15 first locking portion
16 second locking portion
16A distal edge of second locking portion
17, 217 fixing plate portion
17A, 217A distal edge of fixing plate portion (17A lower edge of fixing plate portion; 217A upper edge of fixing plate portion)
30, 230 contact fitting
31 mounting portion
32 erect piece
33, 233 restricting portion
34, 234 facing piece
35, 235 protruding piece
12H, 13H through hole
16S slit

The invention claimed is:

1. A fixture that is capable of being provided with a contact fitting and that is provided for mounting a wall material on a building structure, the fixture comprising:
- a substrate portion that is fixable to the building structure;
- a first side wall portion that protrudes with respect to the substrate portion from one of side edges of the substrate portion;
- a second side wall portion that protrudes from another of the side edges of the substrate portion towards a side that is same as a side towards which the first side wall portion protrudes;
- a support portion that extends from a distal edge of the first side wall portion so as to face the substrate portion, and that approaches the second side wall portion;
- a first locking portion that protrudes from the support portion towards a side opposite to the substrate portion, and that is bent towards a side of the first side wall portion;
- a second locking portion that protrudes from the support portion towards the side opposite to the substrate portion, and that is bent towards a side of the second side wall portion; and
- a fixing plate portion that extends from a distal edge of the second side wall portion so as to face the substrate portion, and that is disposed at a location closer than the support portion to the substrate portion, wherein the contact fitting includes
- a mounting portion that, in contact with the fixing plate portion from the side opposite to the substrate portion, is fixable to the fixing plate portion, and
- an erect piece that is erect in a direction that intersects the mounting portion and that protrudes towards the side opposite to the substrate portion.

2. The fixture according to claim 1, wherein the contact fitting includes a restricting portion that protrudes from the mounting portion in a direction opposite to the erect piece, and that is contactable with a distal edge of the fixing plate portion.

3. The fixture according to claim 2, wherein the contact fitting includes a facing piece that extends from the restricting portion so as to face the mounting portion, and that forms a gab between the facing piece and the mounting portion, a size of the gap being substantially equal to a plate thickness of the fixing plate portion.

4. The fixture according to claim 3, wherein the contact fitting includes a protruding piece that protrudes from the restricting portion in a direction opposite to the facing piece.

5. The fixture according to claim 1, wherein the fixture has a through hole that is formed in, of the first side wall portion and the second side wall portion, at least the first side wall portion.

6. The fixture according to claim 1, wherein the second side wall portion is inclined so as to approach the first side wall portion with decreasing distance to a side of the fixing plate portion from a side of the substrate portion.

7. The fixture according to claim 1, wherein a slit that is recessed from a distal edge towards the support portion is formed in at least one of the first locking portion and the second locking portion.

8. A wall structure in which a wall material is mounted on a building structure by using a fixture that is capable of being provided with a contact fitting, wherein the fixture includes a substrate portion that is fixable to the building structure;

a first side wall portion that protrudes with respect to the substrate portion from one of side edges of the substrate portion, a second side wall portion that protrudes from another of the side edges of the substrate portion towards a side that is same as a side towards which the first side wall portion protrudes, a support portion that extends from a distal edge of the first side wall portion so as to face the substrate portion, that approaches the second side wall portion, and that is capable of supporting a rear surface of the wall material, a first locking portion that protrudes from the support portion towards a side opposite to the substrate portion, that is bent towards a side of the first side wall portion, and that is capable of locking one end portion of the wall material, a second locking portion that protrudes from the support portion towards the side opposite to the substrate portion, that is bent towards a side of the second side wall portion, and that is capable of locking another end portion of the wall material, and a fixing plate portion that extends from a distal edge of the second side wall portion so as to face the substrate portion, and that is disposed at a location closer than the support portion to the substrate portion, wherein the contact fitting includes a mounting portion that, in contact with the fixing plate portion from the side opposite to the substrate portion, is fixable to the fixing plate portion, and an erect piece that is erect in a direction that intersects the mounting portion, that, in a state in which the mounting portion is in contact with the fixing plate portion, protrudes towards the side opposite to the substrate portion, and that is capable of contacting a side end portion of the wall material.

9. A fixture for mounting a wall material on a building structure, the fixture comprising:

a substrate portion that is fixable to the building structure;

a first side wall portion that protrudes with respect to the substrate portion from one of side edges of the substrate portion;

a second side wall portion that protrudes from another of the side edges of the substrate portion towards a side that is same as a side towards which the first side wall portion protrudes;

a support portion that extends from a distal edge of the first side wall portion so as to face the substrate portion, and that approaches the second side wall portion;

a first locking portion that protrudes from the support portion towards a side opposite to the substrate portion, and that is bent towards a side of the first side wall portion;

a second locking portion that protrudes from the support portion towards the side opposite to the substrate portion, and that is bent towards a side of the second side wall portion; and a fixing plate portion that extends from a distal edge of the second side wall portion so as to face the substrate portion, and that is disposed at a location closer than the support portion to the substrate portion.

* * * * *